US005934457A

United States Patent [19]

Ueda et al.

[11] Patent Number: 5,934,457

[45] Date of Patent: Aug. 10, 1999

[54] LIQUID CONTAINER

[75] Inventors: Katsuhiro Ueda, Ibaragi; Hisao Takai, Aichi, both of Japan

[73] Assignees: Pentel Kabushiki Kaisha; Toagosei Co., Ltd., both of Japan

[21] Appl. No.: 08/776,494

[22] PCT Filed: May 24, 1996

[86] PCT No.: PCT/JP96/01378

§ 371 Date: Jan. 27, 1997

§ 102(e) Date: Jan. 27, 1997

[87] PCT Pub. No.: WO96/38346

PCT Pub. Date: Dec. 5, 1996

[30] Foreign Application Priority Data

May 29, 1995 [JP] Japan ..... 7-153822

[51] Int. Cl.[6] ..... B65D 81/26

[52] U.S. Cl. ..... 206/204; 215/10; 215/12.1; 215/250; 222/83.5

[58] Field of Search ..... 206/222, 446, 206/204; 215/10, 12.1, 226, 247, 249–257; 222/81, 83, 83.5, 87, 88, 545, 546, 549, 559

[56] References Cited

U.S. PATENT DOCUMENTS

| | | | |
|---|---|---|---|
| 4,867,326 | 9/1989 | O'Meara | 215/226 |
| 5,052,589 | 10/1991 | O'Meara | 215/257 |
| 5,419,459 | 5/1995 | O'Meara | 222/83 |

FOREIGN PATENT DOCUMENTS

| | | |
|---|---|---|
| 50-22992 | 3/1975 | Japan . |
| 52-9658 | 1/1977 | Japan . |
| 58-139479 | 9/1983 | Japan . |
| 2-197758 | 2/1990 | Japan . |
| 5294371 | 11/1993 | Japan . |
| 6135450 | 5/1994 | Japan . |

*Primary Examiner*—Jim Foster
*Attorney, Agent, or Firm*—Adams & Wilks

[57] ABSTRACT

A container comprises a first tubular body, a second tubular body disposed in the first tubular body, and a tubular cap slidably engaged with the first tubular body. The second tubular body has a chamber for containing a liquid and a neck portion protruding from the first tubular body. The neck portion has a surface at an end thereof puncturable to provide a discharge opening. The tubular cap has a first end, a second end, and a needle pin disposed inside of the tubular cap and mounted on an inner wall of the tubular cap at the first end thereof. The tubular cap is slidable on the first tubular body between a first position in which the needle pin is spaced from the surface of the neck portion of the second tubular body, and a second position in which the needle pin punctures the surface of the neck portion to provide the discharge opening. A first air-tight seal maintains the interior of the tubular cap in a hermetically sealed state when the tubular cap is in the first position. A second air-tight seal maintains the interior of the tubular cap in a hermetically sealed state when the tubular cap is in the second position.

23 Claims, 5 Drawing Sheets

LIQUID CONTAINER

TECHNICAL FIELD

The present invention relates to a liquid container for containing a liquid which must not be exposed to the moisture, since such liquid is solidified upon absorbing the moisture in the air and becomes no longer usable, as represented by a cyanoacrylate-type instantaneous adhesive agent, and a liquid which must not be dried, and thus solidified, and which requires time before it can be used again, as represented by a rectifying (retouching) liquid.

BACKGROUND ART

A known container of this type, for example, a container containing an instantaneous adhesive agent has a structure in which the discharge hole is closed by interposing a stopper member between a cap and a container body before it is used by a user, the stopper member is removed when the container is to be used by the user, and the discharge hole is formed by being pierced by a needle pin projected at the center of the inner top of the cap (Japanese Patent Laid-Open No. 6-135450/1994).

As a container for containing a liquid which becomes no longer usable upon absorbing the moisture in the air as represented by the cyanoacrylate-type instantaneous adhesive agent, furthermore, there has been known a one-push-squeeze-type double-structured adhesive container comprising a flexible inner container filled with an adhesive solution; a squeeze-type flexible outer case body for hermetically accommodating said flexible inner container with its outlet at the upper end being outwardly protruded and forming a closed space inside therein so as to be pushed from the outer side; and a cap for wrapping the outlet at the tip of said flexible inner container and the upper end of said flexible outer case body and detachably having a piercing member with a pin in a recessed portion formed at a suitable position thereof, wherein the flexible outer case body has a drying agent-containing chamber in which is hermetically contained a drying agent between the bottom end thereof and the bottom end of said flexible inner container as disclosed in Japanese Patent Laid-Open No. 5-294371/1993.

However, the container disclosed in Japanese Patent Laid-Open No. 6-135450/1994 has a problem in regard to the handling since the stopper member must be removed by the user prior to using the container.

According to the container disclosed in Japanese Patent Laid-Open No. 5-294371/1993, a drying agent-containing chamber is provided between the bottom end of the flexible outer case body and the bottom end of the flexible inner container, and a drying agent is sealed in the drying agent-containing chamber. However, the drying agent is placed in a closed space formed between the flexible outer case body and the flexible inner container, and the effect of the drying agent is limited within a closed space only but does not extend to the inside of the cap. Though the outlet at the tip of the flexible inner container has been closed before it is used by the user, the container, in general, has been made of a synthetic resin which permits the air to permeate to some extent. Therefore, the instantaneous adhesive agent inside absorbs the moisture contained in the air that has permeated therethrough, whereby the liquid is solidified and becomes no longer usable. In other words, the liquid tends to be solidified near the liquid discharge hole. This problem is caused even after the user started to use the container.

SUMMARY OF THE INVENTION

A first object of the present invention is to provide a liquid container which enables the discharge hole to be easily pierced by the needle pin when the liquid container is to be used for the first time. A second object of the present invention is to provide a liquid container which prevents the liquid from solidifying near the discharge hole at the tip of neck of the container body before the container is used and after the container is used. The container of the first object is suited for containing a liquid that must not be exposed to the moisture and a liquid that must not be dried, and the container of the second object is suited for containing a liquid that must not be exposed to the moisture.

According to a first aspect of the present invention, a liquid container comprises a container body having therein a liquid-containing chamber for containing a liquid and a discharge hole which has been closed at a tip of a neck portion thereof, an outer container body for containing the container body, and a cap engaged with the outer container body, the container body being so arranged in the outer container body that the neck portion of the container body protrudes beyond the outer container body, the cap having a needle pin formed on the inner top panel thereof and further having, at an open end thereof, a stopper portion formed integrally therewith or as a separate body so as to be removed as the cap is moved in the direction of discharge hole of the container body, and the cap being fastened to the outer container body in a manner that it can be moved, wherein a first air-tight portion is provided to shut-off the external air by the inner surface of the cap and the outer container body in a state where a distance is maintained between the needle pin and the discharge hole before the container is used, and a second air-tight portion is provided to shut-off the external air by the inner surface of the cap and the outer container body in a state where the container is used by piercing the discharge hole by the needle pin.

According to a second aspect of the present invention, a liquid container comprises a container body having therein a liquid-containing chamber for containing a liquid and a discharge hole which has been closed at a tip of a neck portion thereof, an outer container body for containing the container body, and a cap engaged with the outer container body, the container body being so arranged in the outer container body that the neck portion of the container body protrudes beyond the outer container body, the cap having a needle pin formed on the inner top panel thereof, and the cap being fastened to the outer container body in a manner that it can be moved, wherein a first air-tight portion is provided to shut-off the external air by the inner surface of the cap and the outer container body in a state where a distance is maintained between the needle pin and the discharge hole before the container is used, and a second air-tight portion is provided to shut-off the external air by the inner surface of the cap and the outer container body in a state where the container is used by piercing the discharge hole by the needle pin.

According to a third aspect of the present invention, a container for containing a liquid that must not be exposed to the moisture comprises a container body having therein a liquid-containing chamber for containing a liquid that must not be exposed to the moisture and a discharge hole which has been closed at a tip of a neck portion thereof, an outer container body for containing the container body, and a cap engaged with the outer container body, the container body being so arranged that the neck portion of the container body protrudes beyond the outer container body and that space is formed communicating with the inside of the cap, a drying agent being placed in the space, the cap having a needle pin formed on the inner top panel thereof and further having, at an open end thereof, a stopper portion formed integrally therewith or as a separate body so as to be removed as the cap is moved in the direction of discharge hole of the container body, and the cap being fastened to the outer container body in a manner that it can be moved and permits the inside of the cap to communicate with the space, wherein a first air-tight portion is provided to shut-off the external air by the inner surface of the cap and the outer container body in a state where a distance is maintained between the needle pin and the discharge hole before the container is used, and a second air-tight portion is provided to shut-off the external air by the inner surface of the cap and the outer container body in a state where the container is used by piercing the discharge hole by the needle pin.

According to a fourth aspect of the present invention, a container for containing a liquid that must not be exposed to moisture comprises a container body having therein a liquid-containing chamber for containing a liquid that must be kept off the moisture and a discharge hole which has been closed at a tip of a neck portion thereof, an outer container body for containing the container body, and a cap engaged with the outer container body, the container body being so arranged that the neck portion of the container body protrudes beyond the outer container body and that space is formed communicating with the inside of the cap, a drying agent being placed in the space, the cap having a needle pin formed on the inner top panel thereof, and the cap being fastened to the outer container body in a manner that it can be moved and permits the inside of the cap to communicate with the space, wherein a first air-tight portion is provided to shut-off the external air by the inner surface of the cap and the outer container body in a state where a distance is maintained between the needle pin and the discharge hole before the container is used, and a second air-tight portion is provided to shut-off the external air by the inner surface of the cap and the outer container body in a state where the container is used by piercing the discharge hole by the needle pin.

In the operation for piercing the discharge hole by the needle pin according to the present invention, the discharge hole that has been closed can be easily pierced by the needle pin by moving the cap in the direction of the discharge hole of the container body.

As for preventing the liquid from solidifying near the discharge hole at the tip of the neck portion of the container body, space communicating with the inside of the cap is formed between the outer container body and the container body, and the cap is reliably and hermetically sealed owing to the first and second air-tight portions. Therefore, the effect of the drying agent placed between the outer container body and the container body extends to the inside of the cap, and then can prevent the liquid from solidifying near the discharge hole at the tip of the neck portion of the container body.

DETAILED DESCRIPTION OF THE PREFERRED EMBODIMENTS

The invention will now be described in detail with reference to the accompanying drawings.

Figure 1:
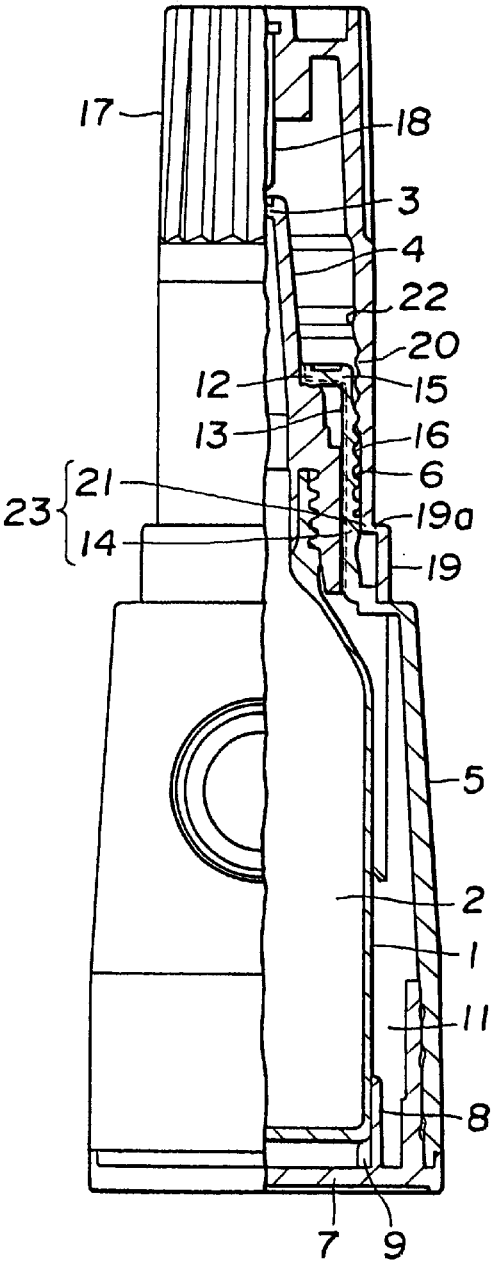
FIG. 1 is view in partial section illustrating a first embodiment of a liquid container according to the present invention.
Figure 2:
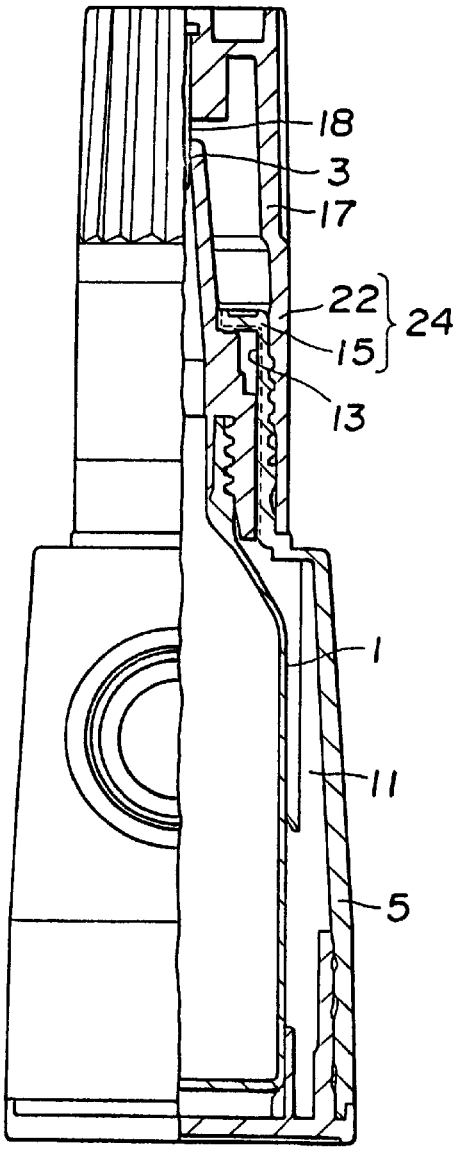
FIG. 2 is a view in partial section illustrating a state after a discharge port of FIG. 1 is pierced to form a discharge hole.
Figure 3:
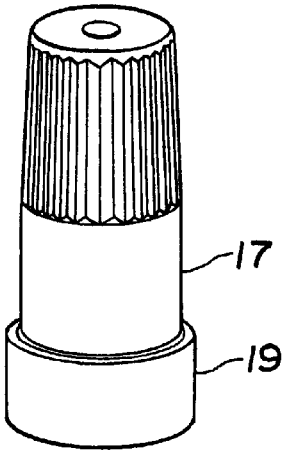
FIG. 3 is a perspective view of a cap of FIG. 1.

FIGS. 1 to 3 illustrate a first embodiment of the present invention. A container body 1 contains therein a liquid-containing chamber 2 for containing a liquid which is solidified upon absorbing the moisture in the air and becomes no longer usable as represented by a cyanoacrylate-type instantaneous adhesive agent, or a liquid that must not be dried since it is solidified upon drying and requires a time before it can be used again as represented by a rectifying liquid. The front part of the liquid-containing chamber 2 comprises a neck portion 4 having, at the tip thereof, a discharge opening or hole 3. The discharge hole 3 has been closed in FIG. 1 but is pierced by a needle pin 18 planted on the inner top panel of a cap 17 when the cap is moved, as shown in FIG. 2, in a direction of the discharge hole to use the container. The container body 1 is made of polyethylene, polypropylene, polyethylene terephthalate, nylon or a like material. The container body 1 is at least partly constituted by a synthetic resin having an elastic restoring property so that, when it is depressed at least partly, the liquid-containing chamber 2 is pressurized and the liquid is forced to the discharge hole 3. The neck portion 4 may be molded as a unitary structure or may be separately molded and may then be united together.

An outer container body 5 has a small-diameter portion 6 at a tip thereof, a tail plug 7 at a rear portion thereof, and contains the container body 1. An annular bottom protuberance 8 is formed on the tail plug 7 of the outer container body 5, and a size-adjusting rib 9 is formed inside the annular bottom protuberance 8.

Space 11 is formed between the container body 1 and the outer container body 5.

Reference numeral 14 denotes a first air-tight receiving portion, and 15 denotes a second air-tight receiving portion, which will be described presently in detail. Reference numeral 16 denotes a threaded portion formed on the outer periphery of the small-diameter portion 6 of the outer container body 5.

Like the container body 1, the outer container body 5 is made of polyethylene, polypropylene, polyethylene terephthalate, nylon or a like material. The outer container body 5 is at least partly made of a synthetic resin having an elastic restoring property so that, when it is at least partly depressed, the liquid-containing chamber 2 is pressurized through the container body 1 and the liquid is forced to the discharge hole 3.

The cap 17 made of a synthetic resin has the needle pin 18 planted on the inner top panel thereof and has a stopper portion 19 (see FIG. 3) formed at an open end thereof integrally therewith or as a separate body (integrally therewith in FIG. 3), the stopper portion 19 being allowed to move in the direction of the discharge hole 3 of the container body 1 so as to be removed, thereby defining a break-away portion. The cap 17 is fastened to the small-diameter portion 6 of the outer container body 5 being allowed to move. In this embodiment, the fastening is accomplished by forming a threaded portion 20 in the cap, and fitting the threaded portion 20 to the threaded portion 16 formed on the outer periphery of the small-diameter portion 6 of the outer container body 5. The needle pin 18 may be made of a synthetic resin and may be molded together with the cap 17 as a unitary structure.

Reference numeral 21 denotes a first air-tight press-contacted portion, and 22 denotes a second air-tight press-contacted portion.

In the above construction, a first air-tight portion or seal (air shut-off portion) 23 is formed by the first air-tight receiving portion 14 and the first air-tight press-contact portion 21. Communication with the external air in the cap 17 is shut-off until the container is used by a user, and the inside of the cap 17 is maintained in a hermetically sealed state. A second air-tight portion or seal (air shut-off portion) 24 is formed by the second air-tight receiving portion 15 and the second air-tight press-contact portion 22. Communication with the external air in the cap 17 is shut off when the container is stored after use, and the inside of the cap 17 is maintained in a hermetically sealed state. Described below is the shape of the stopper portion 19 of the cap 17 and how to remove it according to the embodiment. In the embodiment, the stopper portion 19 is integrally molded like a ring via a thin portion 19*a*. When the cap 17 is moved in the direction of the container body 1, the thin portion 19*a* is cut. When the cap 17 is further moved in the direction of the container body 1, the needle pin 18 pierces the discharge hole 3 that had been closed due to this motion (see FIG. 2). Thereafter, the stopper portion 19 that is cut is pulled up and is removed.

Figure 4:
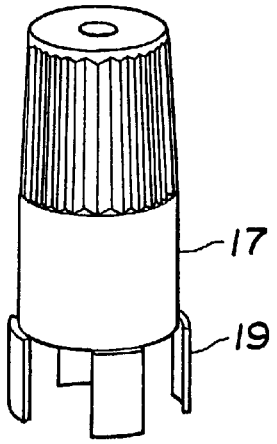
FIG. 4 is a perspective view of a modified example of the cap.
Figure 5:
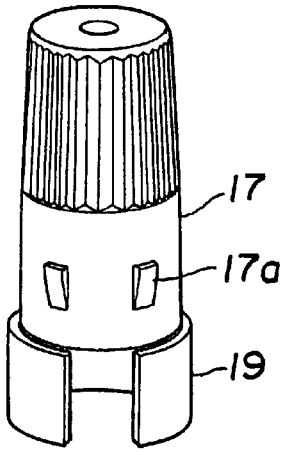
FIG. 5 is a perspective view of another modified example of the cap.

The shape of the stopper portion and the method of removal can be realized in various other ways. As shown in, for example, FIG. 4, the stopper portion 19 may be constituted using three or more ribs (four ribs in FIG. 4). As shown in FIG. 5, furthermore, the stopper portion 19 may be constituted by a C-ring which is separate from the cap 17 and which outwardly opens when the cap 17 is moved in the direction of the container body 1. In this case, the cap 17 is moved to expand the C-ring which is then torn off. As a means for outwardly expanding the C-ring which is the stopper portion 19 when the cap 17 is moved in the direction of the container body 1, tapered protuberances 17*a* are formed on the outer periphery of the cap 17 as shown in FIG. 5. When the cap 17 is moved in the direction of the container body 1, the C-ring is expanded due to the tapered protuberances 17*a*. In effect, the lower end of the cap 17 and(or) the upper end of the C-ring is tapered in order to convert the force in the lengthwise direction of the cap 17 into a force in the circumferential direction. In FIG. 5, the cap 17 and the stopper portion 19 may appear as a unitary structure. In practice, however, they are formed separately from each other. It is, of course, allowable to form the cap 17 and the stopper portion 19 as a unitary structure though the structure requires a complicated method of production.

FIGS. 6 to 9 illustrate a second embodiment of the present invention.

In the first embodiment, the stopper portion 19 is formed integrally with, or separately from, the open end of the cap 17. The second embodiment, however, is different from the first embodiment in that no stopper portion is formed and the cap 17 is moved by being pushed, while in the first embodiment it is accomplished by fitting of the threaded portion 16 of the outer container body 5 to the threaded portion 20 formed on the inner surface of the cap 17, and is different in the first and second air-tight portions. In the figures of the drawing, like portions are assigned identical reference numerals.

In the second embodiment of FIGS. 6 to 9, no stopper portion is formed. Before the container is used by a user, a gap is maintained between the rear end of the cap 17 and a shoulder step portion 5*a* of the outer container body 5, so that the tip of the needle pin 18 of the cap 17 will not come into contact with the discharge hole 3. Moreover, on the small-diameter portion 6 of the outer container body 5 is formed a first air-tight receiving portion 14 in a manner that its front protruded portion is tilted, a first air-tight press-contacted portion 21 is formed on the inner surface of the cap 17 in a manner that its rear protruded portion is tilted, and a first air-tight portion 23 is constituted by the engagement of the two.

After the container is used by pushing the cap 17 (discharge hole 3 is pierced by the needle pin 18), the protruded portion on the inner surface of the cap 17 gets over the protruded portion on the small-diameter portion 6 of the outer container body 5. In other words, the rear tilted portion of the protrusion formed on the small-diameter portion 6 of the outer container body 5 forms a second air-tight receiving portion 15, the front tilted portion of the protrusion formed on the inner surface of the cap 17 forms a second air-tight press-contact portion 22, and a second air-tight portion 24 is formed by the engagement of the two.

In this embodiment, a protruded portion is formed on the small-diameter portion 6 of the outer container body 5 and on the inner surface of the cap 17, and the engaging positions of these protruded portions are changed to form the first and second air-tight portions 23 and 24. The air-tight portions, however, can be constituted in a variety of other ways. As shown in, for example, FIGS. 8 and 9, two dents or recesses are formed in the small-diameter portion 6 of the outer container body 5, the front dent is used as the first air-tight receiving portion 14 and the rear dent is used as the second air-tight receiving portion 15. Moreover, a protruded portion is formed on the inner surface of the cap 17 and is used as the first or the second air-tight press-contact portion 21 or 22. The first air-tight portion 23 is formed by the first air-tight receiving portion 14 and the first air-tight press-contact portion 21, and the second air-tight portion 24 is formed by the second air-tight receiving portion 15 and the second air-tight press-contact portion 22.

In the second embodiment, the first and second air-tight portions are formed by the engagement of the protruded portion formed on the small-diameter portion 6 of the outer container body 5 and the protruded portion formed on the inner surface of the cap 17. The two protruded portions, however, may simply be used as a hook means between the two, and the air-tight portions may be constituted by the same portions as those of the first embodiment.

Figure 10:
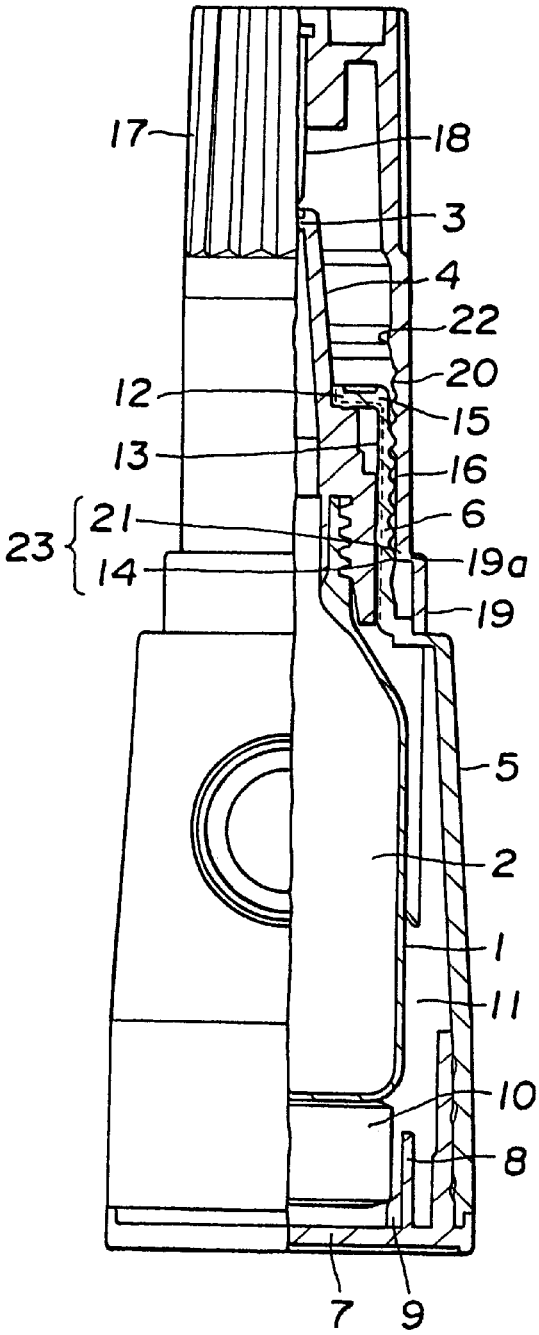
FIG. 10 a view in partial section illustrating a third embodiment of the present invention.
Figure 11:
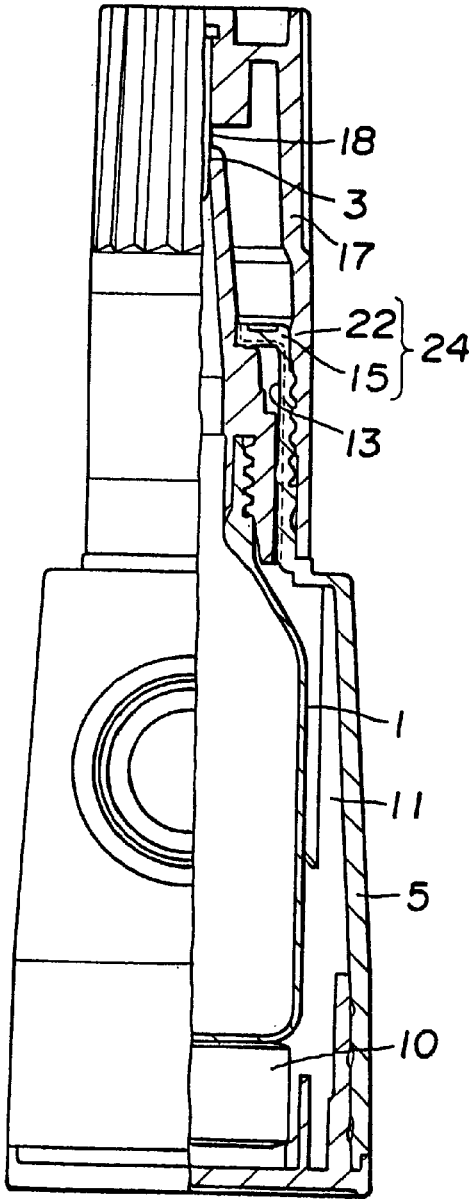
FIG. 11 is a view in partial section illustrating a state after a discharge hole of FIG. 10 is pierced.

FIGS. 10 and 11 illustrate a third embodiment of the present invention which corresponds to the first embodiment of FIGS. 1 and 2. The same members and portions as those of the first embodiment are denoted by the same reference numerals as those of the first embodiment.

This embodiment is different from the first embodiment in that a drying agent 10 is placed between the size-adjusting rib 9 inside the annular bottom protuberance 8 and the bottom of the container body 1, and that space 11 formed between the container body 1 and the outer container body 5 is connected with the inside of the cap 17.

The drying agent 10 may be placed in space 11 which is connected with the inside of the cap 17. In this embodiment, a flange hole 12 is formed in the front end of the small-diameter portion 6 which is in contact with the container body 1, and a groove 13 is formed in the small-diameter portion 6. However, a variety of known means can be employed which permit the flow of the air, such as forming ribs, etc. Even in the first embodiment, the cap 17 is so drawn on the drawing that the inside thereof is connected with space 11 formed between the container body 1 and the outer container body 5. In the first embodiment, however, communication of the inside of the cap 17 with space is not an essential requirement.

Figure 6:
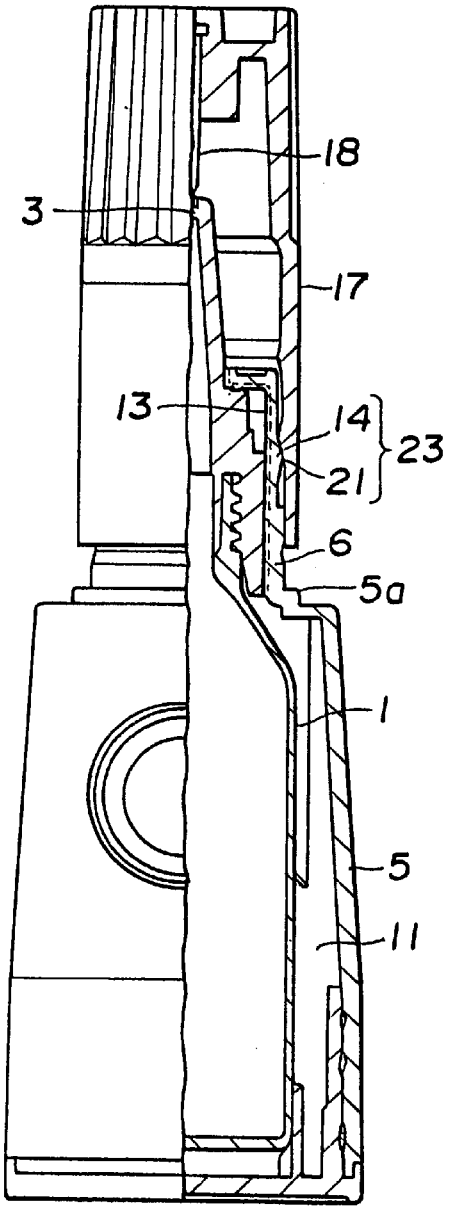
FIG. 6 is a view in partial section illustrating a second embodiment of the present invention.
Figure 7:
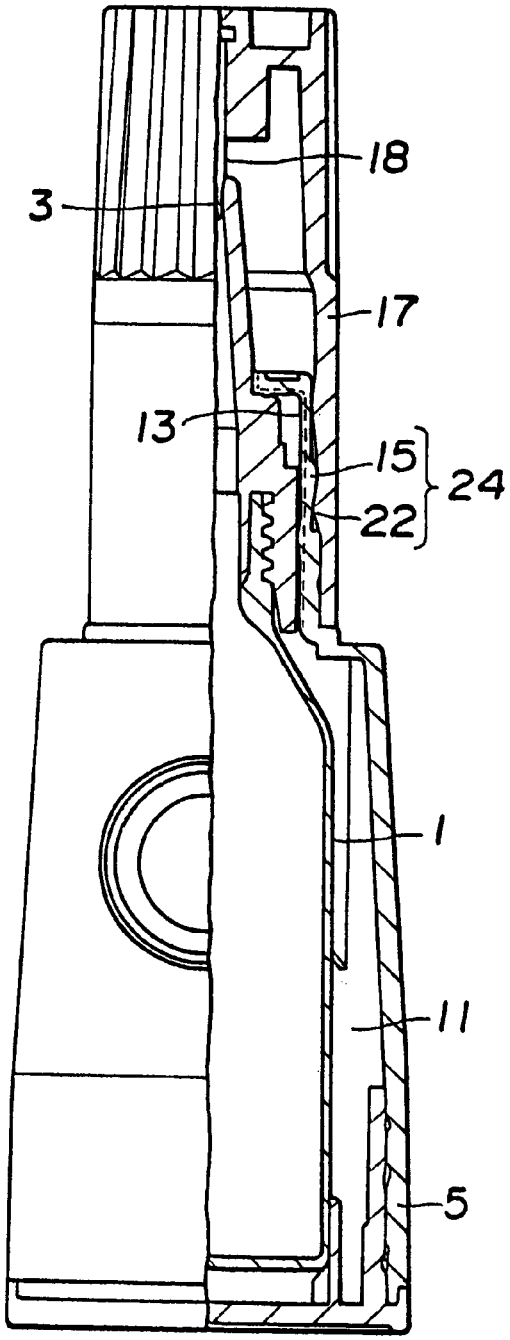
FIG. 7 is a view in partial section illustrating a state after a discharge hole of FIG. 6 is pierced.
Figure 8:
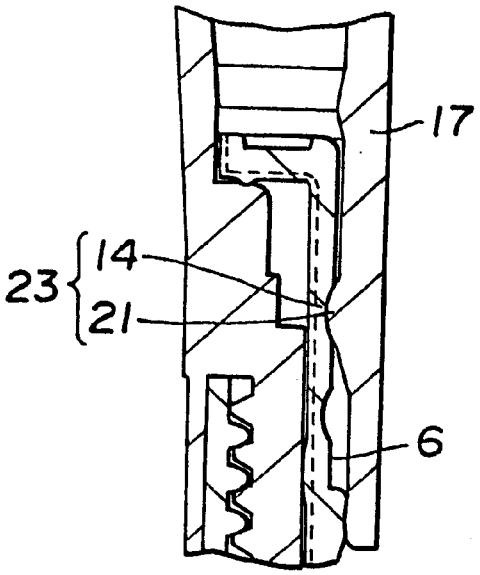
FIG. 8 is a sectional view of major portions illustrating modified example of the second embodiment.
Figure 9:
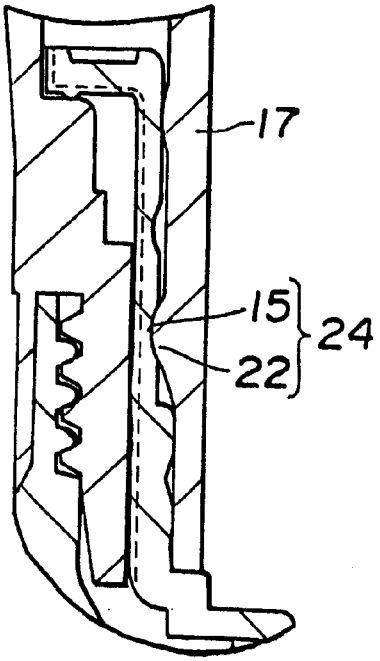
FIG. 9 is a sectional view of major portions illustrating a state after a discharge hole of FIG. 8 is pierced.
Figure 13:
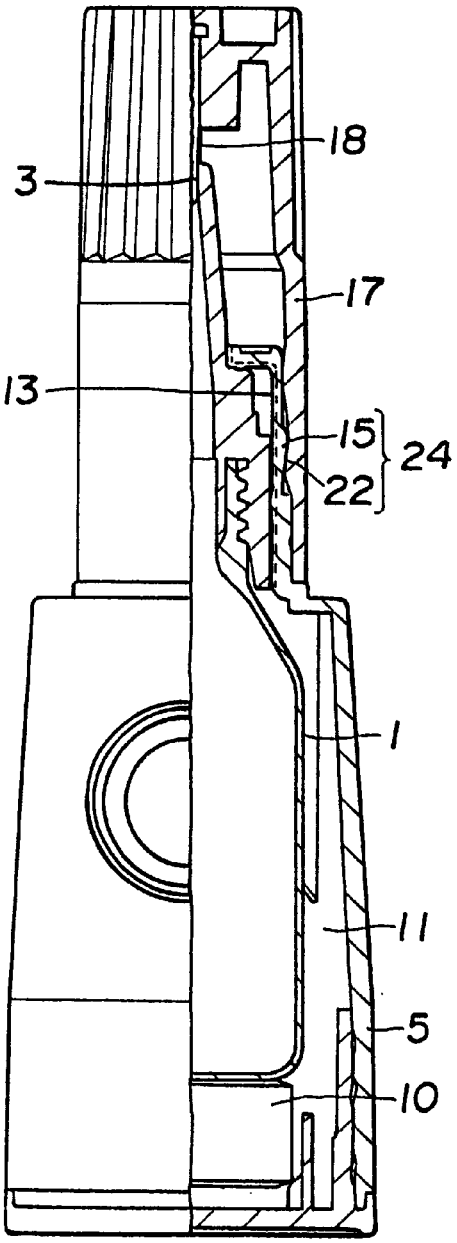
FIG. 13 is a view in partial section illustrating a state after a discharge hole of FIG. 12 is pierced.
Figure 12:
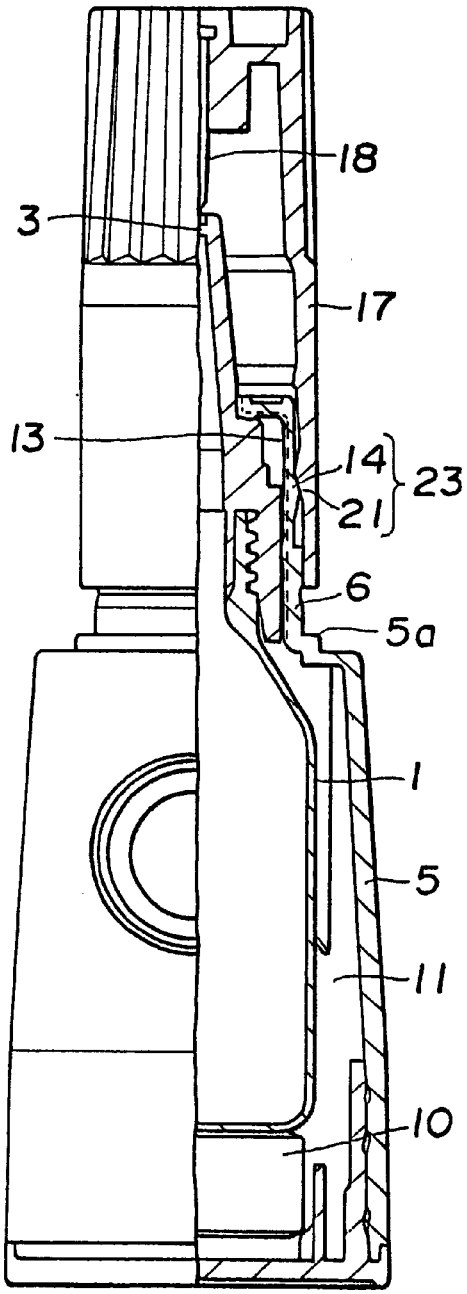
FIG. 12 is a view in partial section illustrating a fourth embodiment of the present invention.

FIGS. 12 and 13 illustrate a fourth embodiment of the present invention which corresponds to the second embodiment of FIGS. 6 and 7. The same members and portions of the second embodiment are denoted by the same reference numerals as those of the second embodiment.

The fourth embodiment is different from the second embodiment in the same points that are making the third embodiment different from the first embodiment.

According to the present invention a, space connected with the inside of the cap is formed between the container body and the outer container body, the first air-tight portion for shutting off the external air is formed by the inner surface of the cap and the outer container body in a state where the needle pin, before the container is used, is kept away from the discharge hole, and the second air-tight portion for shutting off the external air is formed by the inner surface of the cap and the outer container body in a state where the discharge hole is pierced by the needle pin when the container is used. Therefore, the discharge hole is easily pierced by the needle pin by moving the cap in the direction of the discharge hole of the container body. Besides, the drying agent placed in space between the container body 1 and the outer container body 5 exhibits its effect as far as the inside of the cap 17, making it possible to prevent the liquid from solidifying near the discharge hole 3 at the tip of the neck portion 4.

What is claimed is:

1. A liquid container comprising: a first container body; a second container body disposed in the first container body, the second container body having a liquid-containing chamber for containing a liquid and having a neck portion protruding from the first container body, the neck portion having a surface at an end thereof puncturable to provide a discharge opening; a tubular cap having a first end, a second end, an interior spacing, a needle pin disposed in the interior spacing of the cap and mounted on an inner wall of the cap at the first end thereof, and a removable stopper portion integral with the cap at the second end thereof, the cap being slidably engaged with the first container body for movement between a first position in which the needle pin is spaced from the surface of the neck portion of the second container body, and a second position in which the needle Pin punctures the surface of the neck portion to provide the discharge opening and in which the removable stopper portion is removed from the cap; a first air-tight seal for maintaining the interior spacing of the cap in a hermetically sealed state when the cap is in the first position; and a second air-tight seal for maintaining the interior spacing of the cap in a hermetically sealed state when the cap is in the second position.

2. A liquid container according to claim 1; wherein the removable stopper portion and the cap are formed from a single piece of material.

3. A liquid container according to claim 1; wherein the first air-tight seal comprises a first inner surface portion of the cap in air-tight pressure contact with a first outer surface portion of the first container body.

4. A liquid container according to claim 3; wherein the second air-tight seal comprises a second inner surface portion of the cap in air-tight pressure contact with a second outer surface portion of the first container body.

5. A liquid container according to claim 4; wherein the first and second outer surface portions of the first container body are disposed between the cap and the neck portion of the second container body.

6. A liquid container comprising: a first container body; a second container body disposed in the first container body, the second container body having a liquid-containing chamber for containing a liquid and having a neck portion protruding from the first container body, the neck portion having a surface at an end thereof puncturable to provide a discharge opening; a tubular cap having a first end, a second end, and a needle pin disposed inside of the cap and mounted on an inner wall of the cap at the first end thereof, the cap being slidably engaged with the first container body for movement between a first position in which the needle pin is spaced from the surface of the neck portion of the second container body, and a second position in which the needle pin punctures the the surface of the neck portion to provide the discharge opening; a first air-tight seal for maintaining the interior of the cap in a hermetically sealed state when the cap is in the first position; and a second air-tight seal for maintaining the interior of the cap in a hermetically sealed state when the cap is in the second position.

7. A liquid container according to claim 6; wherein the first air-tight seal comprises a first inner surface portion of the cap in air-tight pressure contact with a first outer surface portion of the first container body.

8. A liquid container according to claim 7; wherein the second air-tight seal comprises a second inner surface portion of the cap in air-tight pressure contact with a second outer surface portion of the first container body.

9. A liquid container according to claim 8; wherein the first and second outer surface portions of the first container body are disposed between the cap and the neck portion of the second container body.

10. A container for containing a liquid that must not be exposed to moisture, the container comprising: a first container body; a second container body disposed in the first container body to define a space therebetween, the second container body having a liquid-containing chamber for containing a liquid that must not be exposed to moisture and having a neck portion protruding from the first container body, the neck portion having a surface at an end thereof Puncturable to provide a discharge opening; a drying agent disposed in the space between the first and second container bodies; a tubular cap having a first end, a second end, an interior spacing in fluid communication with the space disposed between the first and second container bodies, a needle pin disposed in the interior spacing and mounted on an inner wall of the cap at the first end thereof, and a removable stopper portion integral with the cap at the second end thereof, the cap being slidably engaged with the first container body for movement between a first position in which the needle pin is spaced from the surface of the neck portion of the second container body, and a second position in which the needle pin punctures the surface of the neck portion to provide the discharge opening and in which the removable stopper portion is removed from the cap; a first air-tight seal for maintaining the interior spacing of the cap in a hermetically sealed state when the cap is in the first position; and a second air-tight seal for maintaining the interior spacing of the cap in a hermetically sealed state when the cap is in the second position.

11. A liquid container according to claim 10; wherein the removable stopper portion and the cap are formed from a single piece of material.

12. A liquid container according to claim 10; wherein the first air-tight seal comprises a first inner surface portion of the cap in air-tight pressure contact with a first outer surface portion of the first container body.

13. A liquid container according to claim 12; wherein the second air-tight seal comprises a second inner surface portion of the cap in air-tight pressure contact with a second outer surface portion of the first container body.

14. A liquid container according to claim 13; wherein the first and second outer surface portions of the first container body are disposed between the cap and the neck portion of the second container body.

15. A container for containing a liquid that must not be exposed to moisture, the container comprising: a first container body; a second container body disposed in the first container body to define a space therebetween, the second container body having a liquid-containing chamber for containing a liquid that must not be exposed to moisture and having a neck portion protruding from the first container body, the neck portion having a surface at an end thereof puncturable to provide a discharge opening; a drying agent disposed in the space between the first and second container bodies; a tubular cap having a first end, a second end, an interior spacing in fluid communication with the space disposed between the first and second container bodies, and a needle pin disposed in the interior spacing and mounted on an inner wall of the cap at the first end thereof, the cap being slidably engaged with the first container body for movement between a first position in which the needle pin is spaced from the surface of the neck portion of the second container body, and a second position in which the needle pin punctures the surface of the neck portion to provide the discharge opening; a first air-tight seal for maintaining the interior spacing of the cap in a hermetically sealed state when the cap is in the first position; and a second air-tight seal for maintaining the interior spacing of the cap in a hermetically sealed state when the cap is in the second position.

16. A liquid container according to claim 15; wherein the first air-tight seal comprises a first inner surface portion of the cap in air-tight pressure contact with a first outer surface portion of the first container body.

17. A liquid container according to claim 16; wherein the second air-tight seal comprises a second inner surface portion of the cap in air-tight pressure contact with a second outer surface portion of the first container body.

18. A liquid container according to claim 17; wherein the first and second outer surface portions of the first container body are disposed between the cap and the neck portion of the second container body.

19. A container comprising: a first tubular body; a second tubular body disposed in the first tubular body, the second tubular body having a chamber for containing a liquid and having a thin wall portion at one end thereof which is puncturable to provide a discharge opening for discharging the liquid from the chamber; a tubular cap slidably engageable with the first tubular body for movement between a first position and a second position, the tubular cap having a closed end and an open end; puncture means for puncturing the thin wall portion of the second tubular body to provide the discharge opening upon movement of the tubular cap to the second position; first seal means for maintaining the tubular cap in a hermetically sealed state when the tubular cap is in the first position; and second seal means for maintaining the tubular cap in a hermetically sealed state when the tubular cap is in the second position.

20. A container according to claim 19; further comprising spacing means for maintaining the puncture means in spaced-apart relation to the thin wall portion of the second tubular body when the tubular cap is in the first position.

21. A container according to claim 20; wherein the spacing means comprises a break-away portion integral with the second end of the tubular cap when the tubular cap is in the first position and adapted to separate from the tubular cap upon movement of the tubular cap to the second position.

22. A container according to claim 19; wherein the second tubular body is disposed within the first tubular body to define a space therebetween in fluid communication with the tubular cap; and further comprising a drying agent disposed in the space between the first and second tubular bodies.

23. A container according to claim 19; wherein the first seal means comprises a first inner surface portion of the tubular cap in air-tight pressure contact with a first outer surface portion of the first tubular body; and wherein the second seal means comprises a second inner surface portion of the tubular cap in air-tight pressure contact with a second outer surface portion of the first tubular body.

* * * * *